US005469900A

United States Patent [19]

Weeks et al.

[11] Patent Number: 5,469,900

[45] Date of Patent: Nov. 28, 1995

[54] FUEL DISPENSING NOZZLE HAVING HOLD-OPEN CLIP WITH LOCKOUT MECHANISM

[75] Inventors: F. Bruce Weeks, Apex; John L. Johnson, Raleigh, both of N.C.

[73] Assignee: EMCO Wheaton, Inc., Morrisville, N.C.

[21] Appl. No.: 456,121

[22] Filed: May 31, 1995

[51] Int. Cl.[6] ..... B65B 1/04; B65B 3/04

[52] U.S. Cl. ..... 141/392; 141/206

[58] Field of Search ..... 141/392, 206–226

[56] References Cited

U.S. PATENT DOCUMENTS

| | | | |
|---|---|---|---|
| 2,981,299 | 4/1961 | Henry | 141/209 |
| 3,088,500 | 5/1963 | Payne | 141/208 |
| 3,521,680 | 7/1970 | Wood et al. | 141/209 |
| 3,603,359 | 9/1971 | Belue | 141/208 |
| 3,638,689 | 2/1972 | Eklund | 141/214 |
| 4,131,140 | 12/1978 | Deters | 141/206 |
| 4,265,281 | 5/1981 | Oberrecht | 141/392 |
| 4,351,375 | 9/1982 | Polson | 141/98 |
| 4,572,255 | 2/1986 | Rabinovich | 141/217 |
| 5,035,271 | 7/1991 | Carmack et al. | 141/206 |
| 5,067,533 | 11/1991 | Carder, Sr. et al. | 141/392 |
| 5,255,723 | 10/1993 | Carmack et al. | 141/206 |

*Primary Examiner*—Henry J. Recla
*Assistant Examiner*—Steven O. Douglas
*Attorney, Agent, or Firm*—Bell, Seltzer, Park & Gibson

[57] ABSTRACT

A fuel dispensing nozzle is disclosed and includes a main body portion containing a fuel passageway and a main valve controlling the flow of fuel through the fuel passageway. A lever extends from the body portion which is operable by the hand of a user holding the nozzle to open the main valve to allow fuel flow through the nozzle and a lever guard is attached to the body and extends around and under the lever. A hold-open clip is pivotally mounted to the lever guard. The lever includes notches which are positioned relative to the hold-open clip so that when the hold-open clip is rotated by the user into its operative position it may engage a notch in the lever and hold the lever in a position where the main valve is opened to allow fuel flow without requiring the user to continue to hold the lever. A removable lockout member is attached to the lever to prevent operation in the automatic hold-open mode by preventing engagement of the hold-open clip with a notch in the lever. The lockout member includes a retention device to prevent manual removal of the lockout member once it is attached to the lever.

7 Claims, 3 Drawing Sheets

FUEL DISPENSING NOZZLE HAVING HOLD-OPEN CLIP WITH LOCKOUT MECHANISM

FIELD OF THE INVENTION

The present invention relates to fuel dispensing nozzles and more particularly to fuel dispensing nozzles having hold-open clips allowing fuel to continue pumping without requiring the operator to hold onto the nozzle.

BACKGROUND OF THE INVENTION

Fuel dispensing nozzles are utilized to deliver fuel into the fuel tank of a vehicle through a fill opening in the tank. Such nozzles typically include a main body portion, a spout connected and carried by the main body portion for insertion into the fill opening of the fuel tank on the vehicle and a connector portion for connecting the nozzle onto the outer end of a hose which delivers fuel from the pump to the nozzle. The main body portion includes a fuel passageway therethrough and a main popper valve disposed within the passageway for controlling the dispensing of fuel through the nozzle.

One problem with use of such nozzles is that the poppet valve is opened manually by the operator pulling on a lever extending from the main body portion. When the lever is released, the main poppet valve returns to the closed position and fuel flow is stopped. Consequently, such fuel nozzles may be provided with a hold-open mechanism which is engaged to maintain fuel flow without requiring the operator to continue holding the valve open. Various approaches to such hold-open mechanisms have been suggested. For example U.S. Pat. No. 4,265,281 to Oberrecht discloses a trigger pivotally mounted on a fuel valve handle which selectively engages with a rack strip which is connected to the hand guard of the fuel dispensing nozzle. U.S. Pat. No. 4,572,255 to Rabinovich discloses a hold-open catch including notches pivotally attached to the rearward portion of the hand guard which selectively engages the outboard end portion of the fuel valve lever. U.S. Pat. No. 5,067,533 to Carder et al. discloses a hold-open mechanism with a clip pivotally attached to the hand guard which selectively engages a step on the fuel valve lever.

However, providing a hold-open mechanism such as those discussed above, while it overcomes the limitation of requiring the operator to continue to hold the fuel dispensing nozzle while pumping fuel, creates additional problems. It is readily understood that fuel is a very combustible liquid. Therefore, overfilling is to be avoided not only to avoid a loss of fuel but also to avoid creation of the serious safety problem associated with open puddles of combustible fuel near pumps in service stations.

This problem is addressed, in part, by inclusion of a shut-off mechanism. This safety feature prevents spillage of fuel onto the ground and contamination of both the air and the soil. Such shut-off mechanisms typically include a venturi within the main body portion of the nozzle which is connected to the outer end of the spout by an internal passageway within the spout. In use, the flow of fuel through the nozzle creates a partial vacuum in this shut-off passageway which draws air out of the fuel tank, which continues so long as fuel is being dispensed and the shut-off passageway remains open. However, when the outer end of this shut-off passageway is blocked by fuel within the vehicle fuel tank, the flow of air ceases and the venturi action creates a substantially increased vacuum. This increased vacuum releases the trigger and permits the closing of the main poppet valve to interrupt the flow of fuel through the nozzle into the vehicle fuel tank.

Such fuel level sensitive shut-off mechanisms only operate to prevent overflow if the fuel dispensing nozzle is kept in the gas tank during operation. Should the fuel nozzle be removed or fall out of the gas tank during operation, fuel flow may continue and the fuel level sensitive shut-off mechanism will fail to prevent the undesirable fuel flow. Such a situation can arise, for example, when a customer, either intentionally to avoid payment or inadvertently, drives away in the customer's automobile while fuel is still flowing. Consequently, there are certain situations where the owner of the service station may wish or be required by Government regulations to prevent use of the hold-open mechanism.

To prevent use of hold-open mechanisms such as those in the United States patents discussed above, some part of the hold-open mechanism itself must be removed. Various problems are present in such an approach. For example, flexibility is lost as removal of the parts may involve difficult and time consuming manual operations. In fact, depending upon the manufacturing method used, such designs may not even allow removal of parts to allow the hold-open mechanism to be disabled. This prevents an owner of the device from switching the nozzle frequently. For example, in some areas the risk of customers driving off while fuel is being dispensed to avoid making payment may be much higher during the nighttime hours. Consequently, it may be desirable to provide the customer with the benefit of the hold-open mechanism during daytime and disabling this feature at night but the difficulty of switching the nozzle on a daily basis is too burdensome.

Another problem with removing parts of the hold-open mechanism to disable it is that the parts being removed are relatively expensive. They are also small enough to be easily misplaced, thereby requiring additional such parts to be purchased if the owner should later desire to set up the nozzle with the hold-open mechanism enabled. In addition, as discussed in U.S. Pat. No. 4,265,281, where disabling the hold-open mechanism involves removal of part of the mechanism, dimensional issues are important to maintain the relative positioning of the two selectively engaging portions of the hold-open mechanism. Making such pieces removable increases the difficulty of maintaining the dimensional tolerances between numerous movable mechanical components of the fuel dispensing nozzle. In addition, should the removable rack in U.S. Pat. No. 4,265,281 be placed on a flat surface and come in contact with heavy objects, as is possible in a service station environment, the rack itself may be flattened and become ineffective as a hold-open device.

With the foregoing in mind, it is an object of the present invention to provide a fuel dispensing nozzle that overcomes the disadvantages and deficiencies of prior fuel dispensing nozzles.

A more specific object of the present invention is to provide a fuel dispensing nozzle that provides a flexible and inexpensive mechanism for switching a fuel dispensing nozzle from manual only to automatic hold-open operation.

SUMMARY OF THE INVENTION

The foregoing objects of the present invention are accomplished by providing a fuel dispensing nozzle having a main body portion which has a fuel passageway extending longitudinally therethrough. The main body portion has mounted in the fuel passageway a main valve having open and closed positions controlling fuel flow through the nozzle.

The main body portion has a connector portion at the ingress end thereof which is adapted to be connected to a hose for delivery of fuel to the nozzle from the pump. A spout is connected at the egress end of the main body portion and has integrally formed therein a fuel dispensing passageway communicatively connected to the fuel passageway of the main body portion.

A manually operable lever extends from the main body portion and is operatively connected to the main valve so that the lever may be moved into a position opening the main valve and a position where the main valve is closed and fuel flow is prevented. A lever guard extends below the lever. A hold-open clip is pivotally attached to the lever guard which is movable between an operative position where it may hold the lever in a position where the main valve is open and an inoperative position where it does not contact the lever. The lever includes notches located to be operatively associated with the hold-open clip to engage the hold-open clip when the hold-open clip is rotated to its operative position to thereby retain the lever in an operative position allowing fuel flow in an automatic hold-open mode of operation.

A lockout member prevents use of the automatic hold-open mode of operation by preventing operative engagement of the hold-open clip with the notches of the lever. In addition, a retention means prevents manual removal of the lockout member from the lever.

Utilizing the nozzle of the present invention, use of the automatic hold-open mode may be readily selected or disabled. It is unnecessary to remove any components of the automatic hold-open mechanism to disable the automatic hold-open mode of operation of the nozzle. In addition, in one embodiment of the present invention, the lockout member is a low cost molded component which may be disposed of after use and a new lockout member may be used the next time it is desired to disable the automatic hold-open mode. By provision of a lockout mechanism, the present invention provides a flexible and inexpensive means for switching a fuel dispensing nozzle from manual only to automatic hold-open operation.

BRIEF DESCRIPTION OF THE DRAWINGS

Some of the objects and advantages of the present invention having been stated, others will appear as the description proceeds when considered in conjunction with the accompanying schematic drawings, in which.

DETAILED DESCRIPTION OF THE PREFERRED EMBODIMENT

Figure 1:
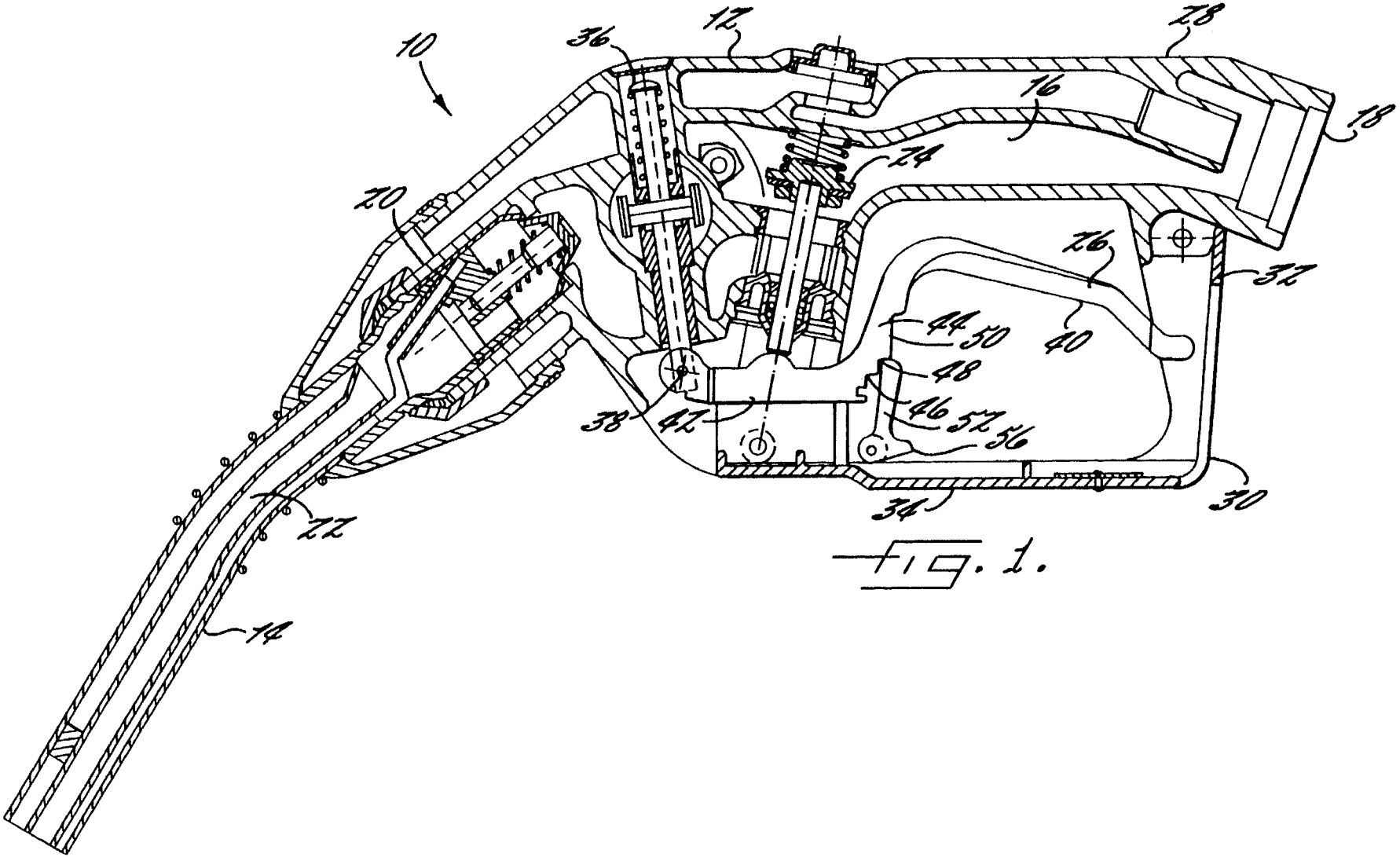
FIG. 1 is a sectional view of an embodiment of the fuel dispensing nozzle of the present invention with the lockout mechanism removed.

Referring now more particularly to the drawings wherein an embodiment of the present invention is illustrated, the fuel dispensing nozzle of the present invention is generally indicated at 10. As shown in FIG. 1, nozzle 10 includes body 12 and spout 14. Body 12 includes fuel passageway 16 extending from ingress end 18 to egress end 20 of body 12. Ingress end 18 is adapted to be connected to a hose (not shown) for delivering fuel from a pump (not shown). Spout 14 is carried by egress end 20 of body 12 and extends outwardly therefrom. Spout 14 includes fuel dispensing passageway 22 extending therethrough. Fuel dispensing passageway 22 is communicatively connected to fuel passageway 16 of body 12 to provide dispensing of fuel into a vehicle fuel tank (not shown).

Figures 2, 3:
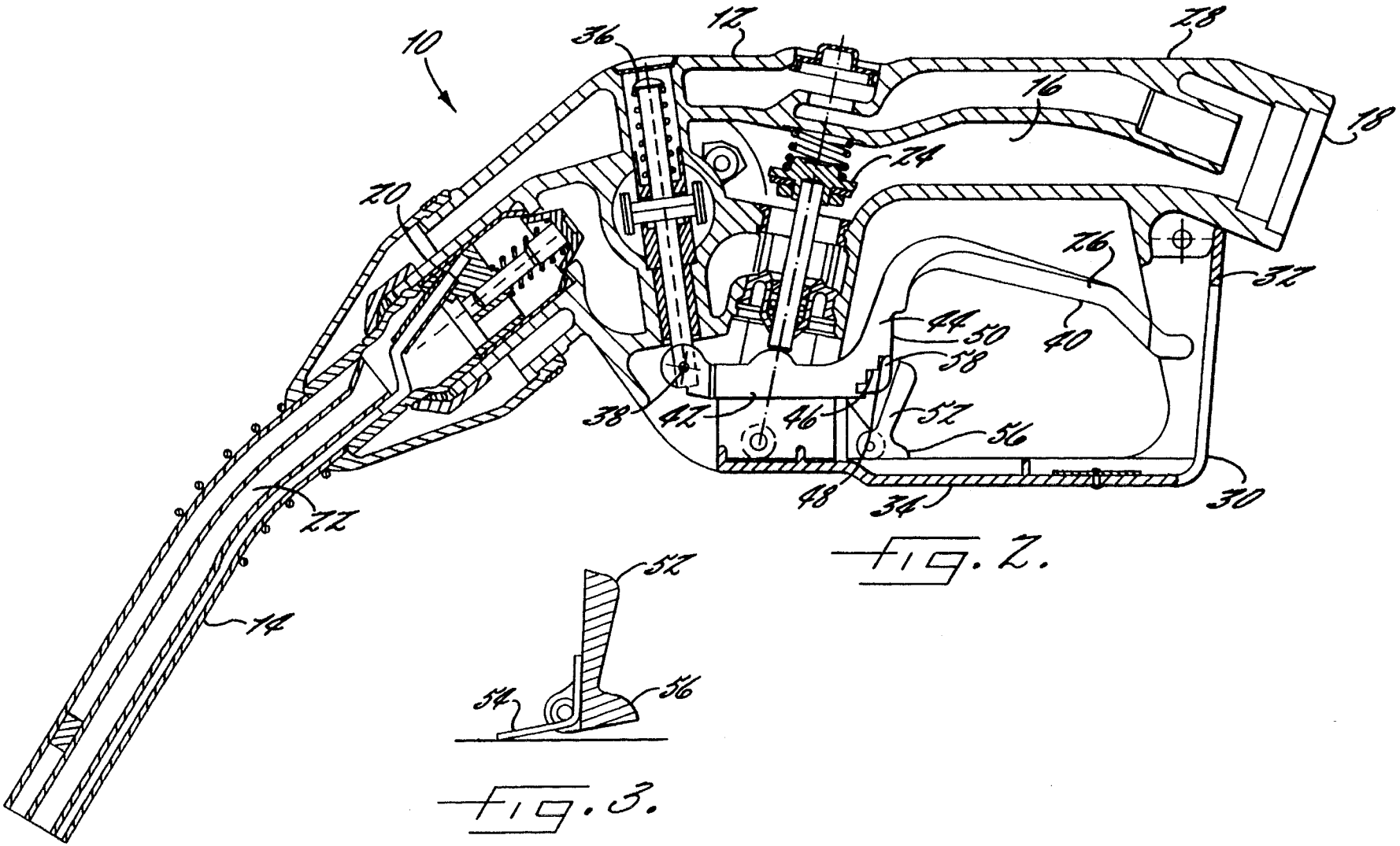
FIG. 2 is a sectional view of an embodiment of the fuel dispensing nozzle of the present invention with the lockout mechanism installed.
FIG. 3 is a sectional view of an embodiment of the hold-open clip of the present invention.

Main Poppet valve 24, or other main valve means, is mounted in body 12 for controlling the flow of fuel through fuel passageway 16. As illustrated in FIGS. 1 and 2, valve 24 is in an open position allowing fuel to flow through nozzle 10. Valve 24 is opened by raising manually operable lever 26 toward body 12. Lever 26 extends from body 12 to be accessible to an operator of nozzle 10. Body 12 includes hand grip portion 28 so that in use an operator may hold nozzle 10 by hand grip portion 28 and readily grasp lever 26 with a finger or fingers of the same hand and progressively open valve 24 by pulling lever 26 toward hand grip portion 28 to allow fuel flow through fuel passageway 16. Lever 26 is spring biased so that when the operator releases lever 26 it returns to a rest position away from hand grip portion 28 allowing valve 24 to return to its closed position to prevent flow of fuel through fuel passageway 16. Nozzle 10 also includes lever guard 30 which is connected to ingress end 18 of body 12 and extends around the region in which lever 26 may be operated including a first portion 32 extending down from ingress end 18 and a second portion 34 extending below lever 26.

As illustrated in FIG. 1, nozzle 10 also includes automatic shut-off valve 36 in body 12. Shut-off valve 36 extends to a shut-off position responsive to fuel level in the tank being filled. The operation of such valves and the method by which fuel level is detected is known and will not be described further herein. Lever 26 is connected to shut-off valve 36. The connection point of lever 26 to shut-off valve 24 defines pivot point 38 for the rotational operation of lever 26. When shut-off valve 36 is extended to the shut-off position it moves pivot point 38 so that lever 26 will reach its travel limit by striking body 12 before main valve 24 is opened.

Figure 4:
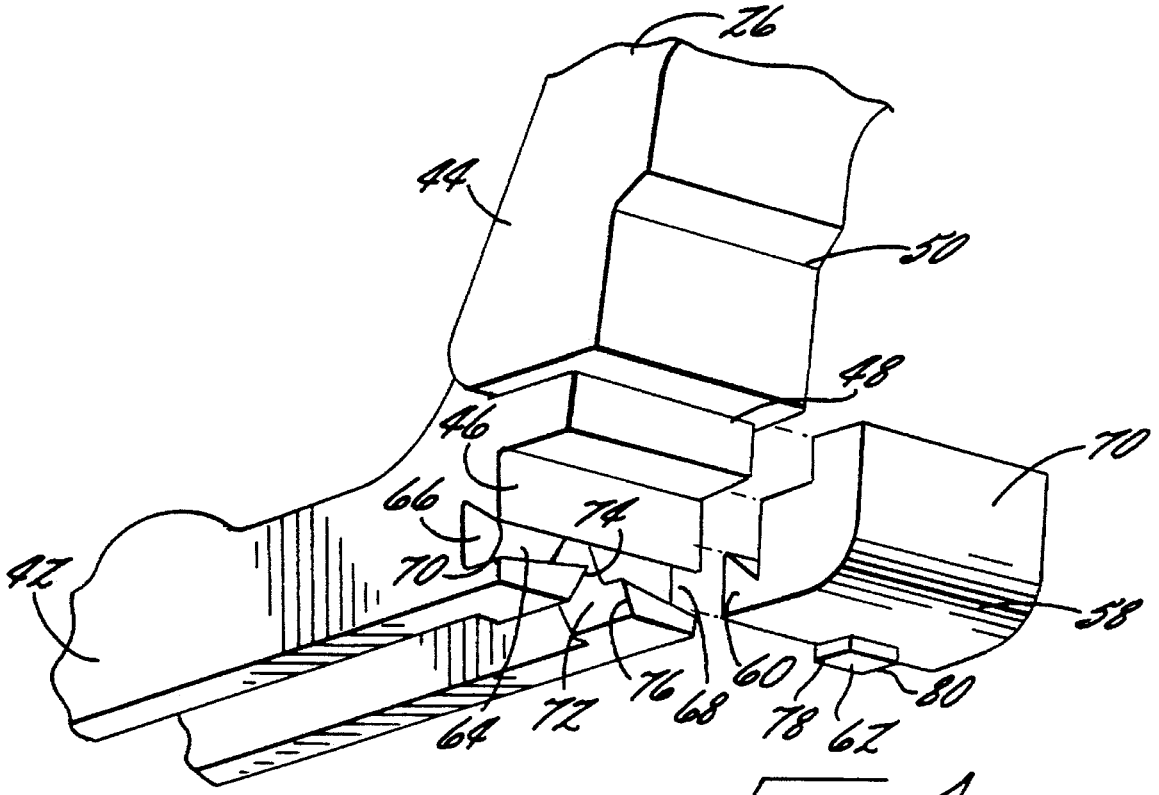
FIG. 4 is a perspective view of the lockout mechanism of the present invention removed from the lever.

Lever 26 as illustrated in FIG. 1 includes grip portion 40 positioned relative to hand grip portion 28 of body 12 to allow operation of lever 26 by a user's hand holding nozzle 10 by hand grip portion 28. Lever 26 includes valve contact portion 42 extending from pivot point 38 past main valve 24 and extending from body 12. Lever 26 also includes latch portion 44 extending from valve contact portion 42 to grip portion 40. As illustrated in FIG. 1 and FIG. 4, latch portion 44 includes notches 46, 48, and 50.

Notches 46, 48, and 50 are operatively associated with hold-open clip 52. Hold-open clip 52 is pivotally connected to second portion 34 of lever guard 30. Hold-open clip 52 is biased into the position shown in FIG. 2 by spring 54 as illustrated in FIG. 3. Hold-open clip 52 includes travel limit portion 56. Travel limit portion 56 is positioned to stop the rotation of hold-open clip 52 by spring 54 by contacting lever guard 30 when hold-open clip 52 is in the position illustrated in FIG. 2.

When hold-open clip 52 is rotated forward to an operative position, as illustrated in FIG. 1, it engages notch 46 or notch 48 (as illustrated in FIG. 1) to thereby retain lever 26 in a position where lever 26 opens main valve 24 to allow flow of fuel through fuel passageway 16 in body 12. When clip 52 is engaged with notch 46 a low rate of fuel flow is provided. When clip 52 is engaged with notch 48 a high rate of fuel flow is provided. Notch 50 is provided to allow clearance for lever 26 to move to its inoperative or off position when hold-open clip 52 is biased into its inoperative or off position as illustrated in FIG. 2. While in the embodiment illustrated lever 26 is provided with notches 46, 48, and 50 and hold-open clip 52 is connected to lever guard 30, it is to be understood that hold-open clip 52 may alternatively be mounted on lever 26 in which case notches 46, 48, and 50 are positioned on lever guard 30.

The automatic hold-open capability of nozzle 10 is provided by the engagement of hold-open clip 52 with notch 46 or notch 48 of lever 26. Hold-open clip 52 is positioned so as to allow the index finger of the user holding nozzle 10 to press on the face of hold-open clip 52 opposite spring 54 while the user's other fingers pull lever 26 into the operative (open) position. The user then allows lever 26 to move back slightly toward the closed position while hold-open clip 52 is pushed into notch 46 or 48. The spring load on lever 26 from main valve 24 provides sufficient force between notch 46 or 48 and hold-open clip 52 to retain clip 52 in notch 46 or 48 after the user releases nozzle 10. To insure proper operation of the hold-open mechanism, lever 26 and hold-open clip 52 are properly positioned relative to each other so as to provide the desired flow rate(s) for automatic operation of nozzle 10. This may be readily accomplished by the manufacturer of nozzle 10 at the time when nozzle 10 is assembled and shipped in which case proper operation may be maintained so long as the parts are not later removed or tampered with by the end user.

According to the present invention, a means is provided to allow the automatic hold-open capability of nozzle 10 to be disabled. This could be accomplished by removal of some component of the hold-open mechanism. However, removal of lever 26 would disable manual operation of nozzle 10. Removal of latch 52 would involve removal of a spring biased component and, likely, also the removal of spring 54. This not only presents a significant risk of loss of these components but also requires an undesirable remounting procedure when automatic operation is again desired. Removal of latch 52 would also allow for manual insertion of some obstruction or device to eliminate the need for the user to manually grasp the level 26 during filling of the tank. This could then pose the safety risk of preventing closure of the main valve 24 when the fuel tank is full.

As shown in FIGS. 3 and 4, lockout member 58 or other lockout means is provided for preventing operative engagement of hold-open clip 52 with notches 46 and 48. Lockout member 58 includes tongue portion 60 or other means for connecting lockout member 58 to lever 26. Lockout member 58 further includes tab 62 positioned intermediate tongue portion 60 and extending therefrom or other retention means for preventing manual removal of lockout member 58 from lever 26.

Figure 5:
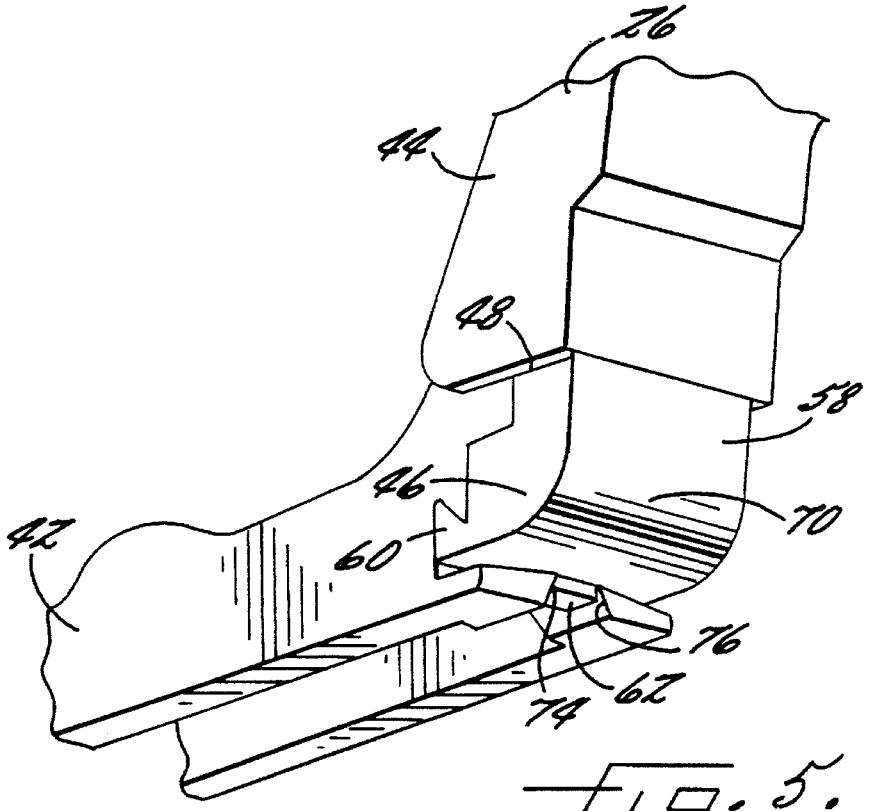
FIG. 5 is a perspective view of the lockout mechanism of the present invention connected to the lever.

To allow attachment of lockout member 58, lever 26 is provided with channel 64 including open ends 66 and 68 positioned adjacent notch 46. Channel 64 longitudinally extends across lever 26 from open end 66 to open end 68. Channel 64 includes first portion 70 defining opening 72 in lever 26. as illustrated in FIG. 4, opening 72 is in the lower surface of lever 26 in the same plane as defines notch 46 and extends across lever 26 from open end 66 to open end 68. To attach lockout member 58 to lever 26, tongue portion 60 of lockout member 58 is inserted through open end 66 or open end 68 of channel 64. Opening 72 of channel 64 has a width of less than the maximum width of channel 64 while tongue portion 60 of lockout member 58 is provided with a width greater than the width of opening 72 but not greater than the maximum width of channel 64. Consequently, when tongue 60 is slid into channel 64, lockout member 58 is attached to lever 26 as illustrated in FIG. 5. While having open ends 66 and 68 at each end of channel 64, which allows insertion of lockout member 58 from either side of lever 26, facilitates insertion by either right or left handed individuals, channel 64 may be provided with only one open end 66 or 68.

As illustrated in FIGS. 4 and 5, lockout member 58 includes a lower face 70 which includes no notches. Therefore, when lockout member 58 is attached to lever 26, lower face 70 of lockout member 58, rather than notches 46 and 48 of lever 26, is positioned to contact hold-open clip 52. Consequently, as illustrated in FIG. 2, hold-open clip 52 is unable to engage lever 26 and hold it in an open position. Fuel is only allowed to flow through nozzle 10 while an operator manually holds lever 26 in an operative (open) position.

While it is desirable to allow lockout member 58 to be easily manually attachable to lever 26, it may also be desirable to prevent lockout member 58 from being removed manually from lever 26. This may be desirable to prevent a user from removing lockout member 58 and using the automatic hold-open capability during a time when the owner of the service station intended nozzle 10 to only operate in manual mode.

As illustrated in FIGS. 4 and 5, lever 26 is provided with slot 72 positioned intermediate channel 64 and communicating with channel 64. Slot 72 includes first edge 74 and second edge 76 laterally displaced from edge 74 along channel 64. Tab 62 of lockout member 58 similarly includes first edge 78 and second edge 80 laterally displaced from first edge 78 along tongue 60. The width of tab 62 from first edge 78 to second edge 80 is less than or equal to the width of slot 72 from first edge 74 to second edge 76 of slot 72. It is to be understood that, depending upon the materials and dimensions chosen for the respective parts, the width of tab 62 prior to the insertion of lockout member 58 into lever 26 may be somewhat wider than the width of slot 72 so long as tab 62 may be mated with slot 72. Tab 62 is positioned on lockout member 58 so as to mate with slot 72 when locking member 58 is connected to lever 26 to, thereby, prevent manual removal of lockout member 58 from lever 26.

Lockout member 58 is preferably plastic. Suitable plastics for lockout member 58 include acetals and nylons. Lever 26 is also preferably manufactured from a plastic, such as acetal or a metal such as aluminum or other materials with sufficient strength to operate main valve 24. Hold-open clip 52 may also be plastic. Suitable plastics for hold open clip 52 include acetals and nylons. By making lockout member 58 as a molded plastic piece, lockout member 58 may be provided at such a low cost that it may be treated as a disposable, single use insert. Therefore, the problem of not misplacing removed parts can be avoided.

In operation, the nozzle of the present invention may readily be switched between manual only and automatic hold-open mold. Lockout member 58 is connected to lever 26 in a simple operation requiring only one hand to position tongue 60 to slide into channel 64. However, after insertion, tab 62 engages in slot 72 and prevents lockout member 58 from being removed from channel 64 manually. While lockout member 58 is attached to lever 26, automatic hold-open operation is prevented. To resume automatic hold-open operation, lockout member 58 must be removed Lockout member 58 may be removed either by a tool designed to flex channel 64 and push tab 62 out of slot 72. Alternatively, sufficient clearance may be provided between lockout member 58 and lever 26 when lockout member 58 is connected to lever 26 so that a screwdriver or similar tool can be inserted to snap lockout member 58 off of lever 26.

The material of lever 26, at least in the portion including channel 64, should be chosen to provide sufficient flexibility to allow tongue portion 60 and tab 62 to pass through channel 64 and allow tab 62 to mate with slot 72. It should also be provided sufficient flexibility so that removal of lockout member 58 will not damage slot 72 in a manner which would prevent reinsertion of lockout member Alternatively, lockout member 58 can be of a sufficiently soft plastic to insure it will deform and release from lever 26 before channel 64 or slot 72 can be damaged.

In the drawings and specifications, there has been set forth a preferred embodiment of the invention, and although specific terms are employed, they are used in a generic and descriptive sense only and not for purposes of limitation. The invention is defined by the following claims, with equivalents of the claims to be included therein.

That which is claimed is:

1. A fuel dispensing nozzle comprising:

(a) a main body portion having a fuel passageway extending from an ingress end of the main body portion to an egress end thereof, the ingress end of said main body portion being adapted to be connected to a hose for delivering fuel from a pump to said nozzle;

(b) a spout carried by the egress end of said main body portion and extending outwardly therefrom, said spout including a fuel dispensing passageway extending therethrough and being communicatively connected to said fuel passageway in said main body portion for dispensing fuel into a vehicle fuel tank;

(c) main valve means mounted in said main body portion for controlling the flow of fuel through said fuel passageway in said main body portion;

(d) a manually operable lever extending from said main body portion and operatively connected with said main valve means, said lever having a first position for opening said main valve means to allow flow of fuel through said fuel passageway in said main body and a second position wherein said main valve means is closed to prevent flow of fuel through said fuel passageway;

(e) a lever guard extending below said lever;

(f) a hold-open clip pivotally mounted to one of said lever and said lever guard for movement between operative and inoperative positions, the other of said lever and said lever guard having a notch operatively associated with said hold-open clip for engagement with said hold-open clip upon pivotal movement of said hold-open clip to said operative position of said hold-open clip to thereby retain said lever in said first position of said lever when said hold-open clip is in said operative position; and, (g) lockout means for preventing operative engagement of said hold-open clip with said notch, wherein said lockout means is a lockout member adapted to be mounted to cover said notch to prevent engagement of said hold-open clip with said notch.

2. A fuel dispensing nozzle according to claim 1 wherein said hold-open clip is pivotally mounted to said lever guard.

3. A fuel dispensing nozzle according to claim 2 wherein said lockout member includes means for connecting said lockout member to said lever and retention means for preventing manual removal of said lockout member from said lever.

4. A fuel dispensing nozzle according to claim 2 wherein said lever includes a channel positioned adjacent said notch, said channel having an open end, said channel longitudinally extending from said open end, said channel further including a first portion defining an opening in said lever, said opening having a width less than the maximum width of said channel, said lockout member having a tongue portion insertable into said channel through said open end of said channel, said tongue portion having a width greater than the width of said opening defined by said first portion of said channel.

5. A fuel dispensing nozzle according to claim 4 further comprising retention means for preventing manual removal of said lockout member from said lever.

6. A fuel dispensing nozzle according to claim 5 wherein said lockout member is plastic.

7. A fuel dispensing nozzle according to claim 5 wherein said retention means comprises;

a slot positioned intermediate said longitudinally extending channel of said lever and communicating with said channel, said slot having a first edge and a second edge displaced from said first edge along said channel;

a tab positioned intermediate said tongue of said locking member and extending therefrom, said tab having a first edge and a second edge laterally displaced from said first edge along said tongue, the width of said tab from said first edge to said second edge being less than the width of said slot from said first edge of said slot to said second edge of said slot;

said tab being positioned so as to mate with said slot when said locking member is connected to said lever to prevent manual removal of said lockout member from said lever.

* * * * *